US005277156A

United States Patent [19]

Osuka et al.

[11] Patent Number: 5,277,156

[45] Date of Patent: Jan. 11, 1994

[54] COMMON-RAIL FUEL INJECTION SYSTEM FOR AN ENGINE

[75] Inventors: Isao Osuka, Nagoya; Toshimi Matsumura, Aichi, both of Japan

[73] Assignee: Nippondenso Co., Ltd., Kariya, Japan

[21] Appl. No.: 842,544

[22] Filed: Feb. 27, 1992

[30] Foreign Application Priority Data

Feb. 27, 1991 [JP] Japan ..... 3-033217

[51] Int. Cl.[5] ..... F02B 77/00; F02M 41/00

[52] U.S. Cl. ..... 123/198 DB; 123/456; 123/333

[58] Field of Search ..... 123/198 DB, 456, 506, 332, 333

[56] References Cited

U.S. PATENT DOCUMENTS

| | | | |
|---|---|---|---|
| 4,083,346 | 4/1978 | Eheim | 123/198 DB |
| 4,195,610 | 4/1980 | Bastenhof | 123/332 |
| 4,403,580 | 9/1983 | Bader | 123/198 DB |
| 4,565,170 | 1/1986 | Grieshaber | 123/198 DB |
| 4,597,369 | 7/1986 | Yasuhara | 123/198 DB |
| 4,777,921 | 10/1988 | Miyaki et al. . | |
| 4,807,583 | 2/1989 | Thornwaite | 123/198 DB |
| 4,862,849 | 9/1989 | Wilson | 123/333 |
| 4,940,034 | 7/1990 | Heim et al. . | |
| 5,058,553 | 10/1991 | Kondo | 123/456 |
| 5,070,848 | 12/1991 | Mitsuyasu | 123/456 |

FOREIGN PATENT DOCUMENTS

| | | |
|---|---|---|
| 0307947 | 3/1989 | European Pat. Off. . |
| 1913808 | 5/1975 | Fed. Rep. of Germany . |
| 2945484 | 5/1981 | Fed. Rep. of Germany . |
| 62-258160 | 11/1987 | Japan . |
| 1-224448 | 9/1989 | Japan . |
| 2-176158 | 7/1990 | Japan . |

*Primary Examiner*—Carl S. Miller

*Attorney, Agent, or Firm*—Cushman, Darby & Cushman

[57] ABSTRACT

A common-rail fuel injection system for an engine includes a fuel injection device for injecting high pressure fuel from a common rail into the engine. A pumping chamber is connected to the common rail. A fuel feed device serves to feed fuel to the pumping chamber. A plunger moves upward and downward in accordance with rotation of an output shaft of the engine. The plunger defines a part of the pumping chamber. A relief valve serves to selectively return fuel from the pumping chamber to a low pressure side via a fuel return passage. The relief valve is urged toward its closed position by a pressure of the fuel in the pumping chamber. A valve closing device serves to close the relief valve. A fuel pumping control device serves to drive and control the valve closing device at a given timing to close the relief valve, thereby enabling a pressure in the pumping chamber to increase in accordance with upward movement of the plunger and pumping a given amount of fuel from the pumping chamber to the common rail. An engine speed detecting device serves to detect a rotational speed of the output shaft of the engine. In cases where an engine rotational speed detected by the engine speed detecting means is equal to or higher than a predetermined reference speed, a fuel feed suspending device serves to suspend fuel feed to the pumping chamber by the fuel feed means.

6 Claims, 8 Drawing Sheets

COMMON-RAIL FUEL INJECTION SYSTEM FOR AN ENGINE

BACKGROUND OF THE INVENTION

1. Field of the Invention

This invention relates to a common-rail fuel injection system for an engine.

2. Description of the Prior Art

Common-rail fuel injection systems for diesel engines are disclosed in various documents such as Japanese published unexamined patent application 65-258160, Japanese published unexamined patent application 2-176158, European published patent application 0307947-A2, U.S. Pat. No. 4,777,921, and U.S. Pat. No. 4,940,034.

The common-rail fuel injection systems include a high pressure tubing which forms a pressure accumulator referred to as "a common rail". The fuel injection systems of this type also include high pressure fuel supply pumps for feeding high pressure fuel to the common rail, and solenoid valves for selectively allowing the high pressure fuel to flow from the common rail through injectors into engine cylinders.

The high pressure fuel supply pumps in the common-rail fuel injection system include pumping chambers, and movable plungers partially defining the pumping chambers respectively. The plungers are driven by the diesel engine through a suitable mechanism. The drive of the plungers pressurizes fuel in the pumping chambers, forcing the fuel from the pumping chambers into the common rail. In general, spill or relief solenoid valves are connected to the pumping chambers respectively. Closing and opening the relief solenoid valves enables and disables pumping the fuel from the pumping chambers into the common rail. Thus, the rate of fuel supply to the common rail is adjusted by controlling the relief solenoid valves.

The relief solenoid valves are of the normally-open type. The valve members of the relief solenoid valves are designed so that they will be urged by the pressure in the pumping chambers toward their closed positions. When a high pressure pump plunger is required to drive the fuel into the common rail, the related relief solenoid valve is energized to move its valve member to a closed position so that the fuel supply from the pumping chamber to the common rail is enabled. Then, the valve member is held in the closed position by a resulting high pressure in the pumping chamber, and the relief solenoid valve can be de-energized to save electric power. The rate of fuel supply to the common rail is adjusted by controlling the timing of energizing the relief solenoid valve, that is, the timing of closing the relief solenoid valve.

Prior art common-rail fuel injection systems have the following problems. Under overrunning conditions where the crankshaft of an engine rotates at a high speed and the fuel supply to a common rail is required to be inhibited, since the mean speed of movement of plungers in high pressure fuel supply pumps is high, the inertia of fluid in pumping chambers is great and thus relief solenoid valves tend to be closed by the fluid inertia even in the absence of relief solenoid valve energizing signals. Closing the relief solenoid valves results in unwanted fuel supply to the common rail. Such unwanted fuel supply to the common rail tends to cause an excessively high pressure in the common rail and a damage to the common rail.

SUMMARY OF THE INVENTION

It is an object of this invention to provide an improved common-rail fuel injection system for an engine.

A first aspect of this invention provides a common-rail fuel injection system for an engine which comprises fuel injection means for injecting high pressure fuel from a common rail into the engine; a pumping chamber connected to the common rail; fuel feed means for feeding fuel to the pumping chamber; a plunger moving upward and downward in accordance with rotation of an output shaft of the engine and defining a part of the pumping chamber; a relief valve for selectively returning fuel from the pumping chamber to a low pressure side via a fuel return passage, the relief valve being urged toward its closed position by a pressure of the fuel in the pumping chamber; valve closing means for closing the relief valve; fuel pumping control means for driving and controlling the valve closing means at a given timing to close the relief valve, thereby for enabling a pressure in the pumping chamber to increase in accordance with upward movement of the plunger, and for pumping a given amount of fuel from the pumping chamber to the common rail; engine speed detecting means for detecting a rotational speed of the output shaft of the engine; and fuel feed suspending means for, in cases where an engine rotational speed detected by the engine speed detecting means is equal to or higher than a predetermined reference speed, suspending fuel feed to the pumping chamber by the fuel feed means.

A second aspect of this invention provides a common-rail fuel injection system for an engine which comprises a common rail; means for injecting fuel into the engine from the common rail; means for pumping fuel into the common rail; means for feeding fuel to the pumping means; means for detecting a rotational speed of the engine; means for comparing the detected rotational speed of the engine with a predetermined reference speed; and means for disabling the feeding means in response to a result of said comparing by the comparing means.

DESCRIPTION OF THE PREFERRED EMBODIMENT

Figure 1:
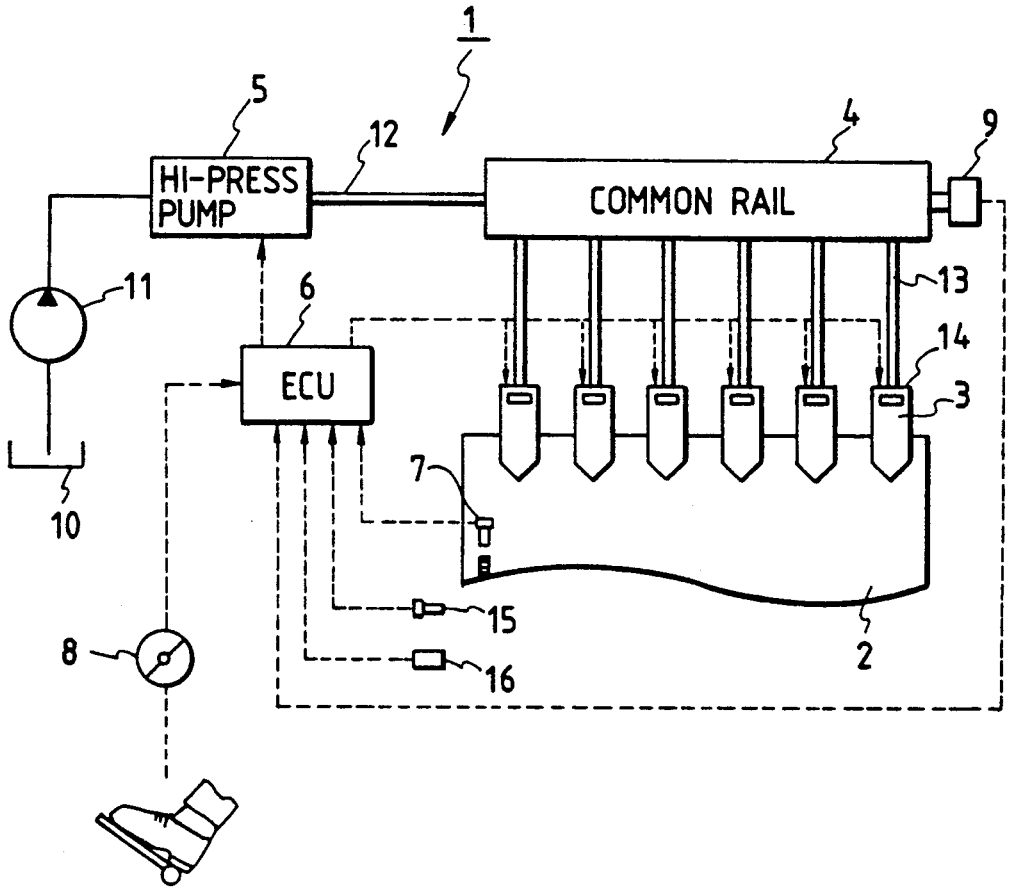
FIG. 1 is a diagram of a common-rail fuel injection system according to an embodiment of this invention.

With reference to FIG. 1, a common-rail fuel injection system 1 for a diesel engine 2 includes injectors 3 for injecting fuel into cylinders of the engine 2, a common rail 4 for storing high pressure fuel to be supplied to the fuel injectors 3, variable discharge high pressure pumps 5, and an electronic control unit (ECU) 6 for controlling the fuel injectors 3 and the variable discharge high pressure pumps 5. The number of the variable discharge high pressure pumps 5 is equal to a half of the number of cylinders of the engine 2. In the embodiment of FIG. 1, the engine 2 has six cylinders, and there are three variable discharge high pressure pumps 5.

An engine speed sensor 7 and an accelerator sensor 8 detect operating conditions of the engine 2. Specifically, the engine speed sensor 7 detects the rotational speed of the crankshaft (the output shaft) of the engine 2, that is, the engine speed. The accelerator sensor 8 detects the position of an accelerator pedal, that is, a required power output of the engine 2 (the load on the engine 2). A common-rail pressure sensor 9 detects the pressure PC in the common rail 4.

The ECU 6 is informed of the operating conditions of the engine 2 by the engine speed sensor 7 and the accelerator sensor 8, and calculates a target common-rail pressure PFIN on the basis of the operating conditions of the engine 2. The target common-rail pressure PFIN is designed so as to realize a fuel injection pressure at which the conditions of burning of fuel in the engine 2 can be optimized. The ECU 6 is also informed of the actual pressure in the common rail 4 by the common-rail pressure sensor 9. The ECU 6 controls the variable discharge high pressure pumps 5 in response to the actual pressure PC in the common rail 4 so that the actual pressure PC can be maintained at the target common-rail pressure PFIN according to feedback control.

The variable discharge high pressure pumps 5 draw fuel from a fuel tank 10 via a low pressure fuel feed pump 10, pressurizing the fuel and pumping the pressurized fuel into the common rail 4 via fuel feed lines 12 in response to control instructions from the ECU 6.

The fuel injectors 3 are connected to the common rail 4 via fuel feed lines 13 respectively so that the fuel injectors 3 receive the fuel of a pressure equal to the target common-rail pressure from the common rail 4. The fuel injectors 3 include control solenoid valves 14. The control solenoid valves 14 are opened and closed by injector control instructions from the ECU 6, periodically allowing and inhibiting the injection of the high pressure fuel into the cylinders of the engine 2 via the fuel injectors 3.

The injector control instructions are intended to adjust the fuel injection rate and the fuel injection timing. The injector control instructions are generated by the ECU 6 in response to the engine operating conditions detected by the engine speed sensor 7 and the accelerator sensor 8.

A crank angle sensor 15 detects the angular position of the crankshaft of the engine 2. A cylinder discrimination sensor 16 discriminates between the cylinders of the engine 2. The ECU 6 determines timings of outputting the injector control instructions on the basis of the information detected by the crank angle sensor 15 and also the information detected by the cylinder discrimination sensor 16. In addition, the ECU 6 determines timings of outputting the control instructions to the variable discharge high pressure pumps 5 on the basis of the information detected by the crank angle sensor 15 and also information detected by a cam angle sensor 38 (described later).

Figure 2:
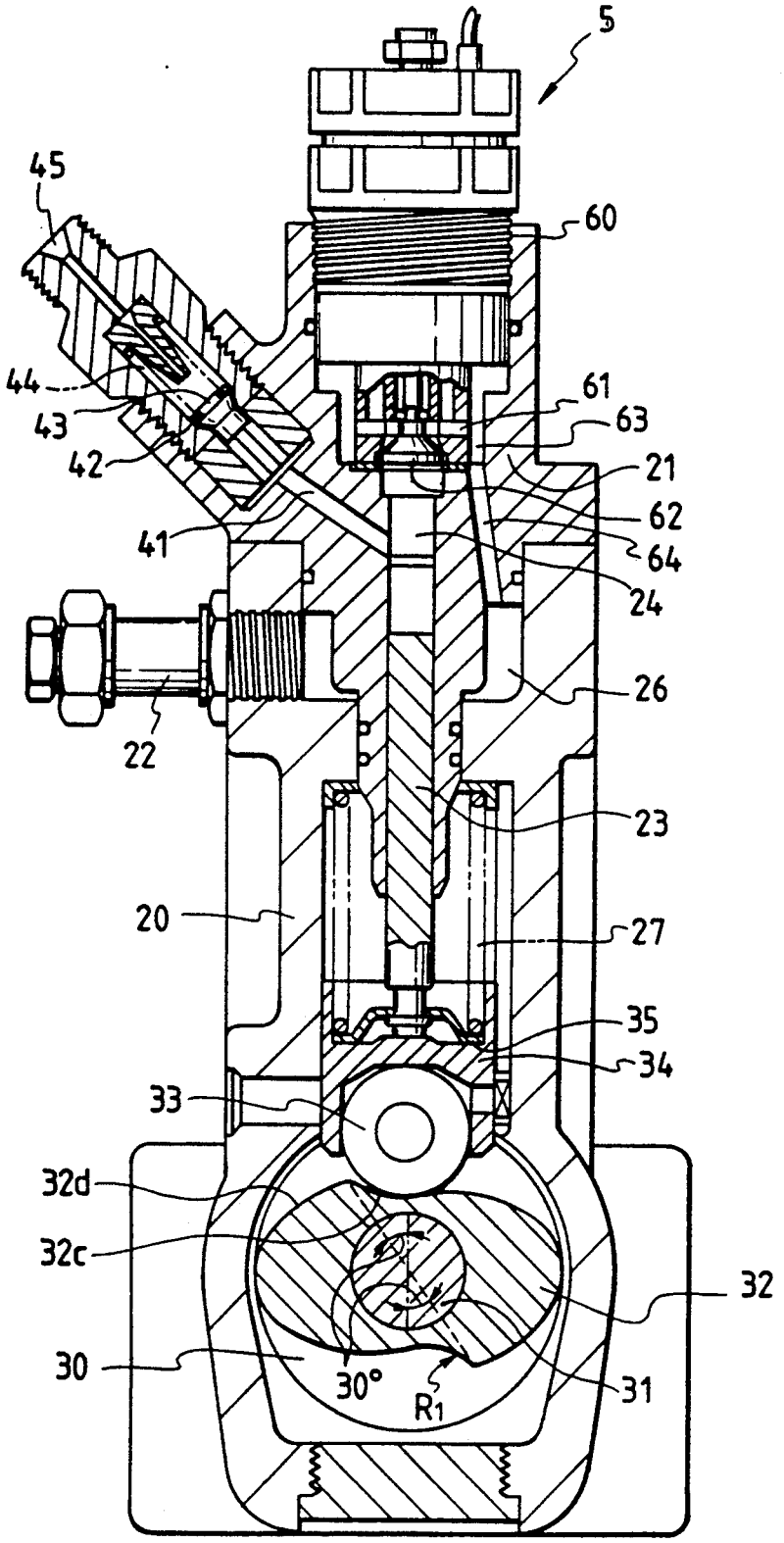
FIG. 2 is a sectional view of a variable discharge high pressure pump in FIG. 1.
Figure 3:
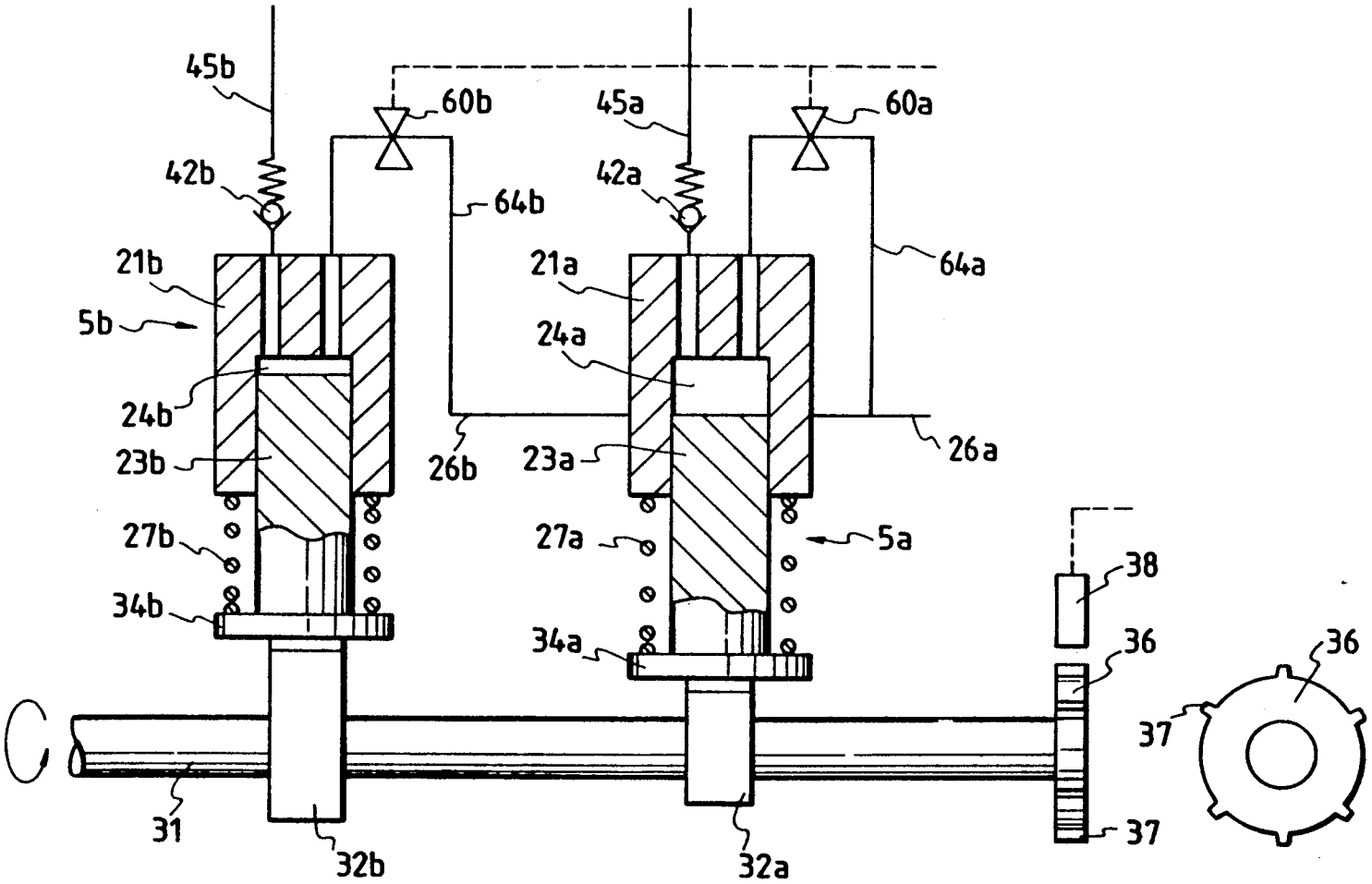
FIG. 3 is a diagram of variable discharge high pressure pumps in FIG. 1.
Figure 12:
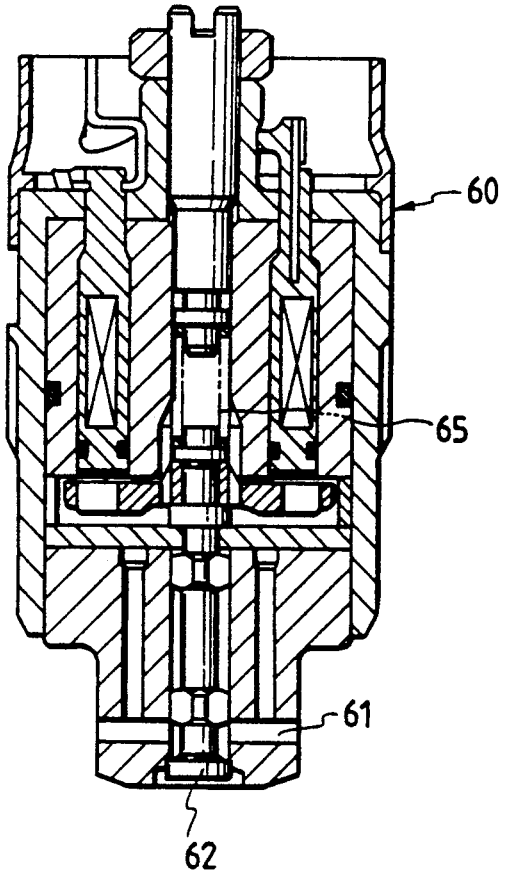
FIG. 12 is a sectional view of a part of a variable discharge high pressure pump in FIG. 1.

The variable discharge high pressure pumps 5 will now be described with reference to FIGS. 2, 3, and 12. The variable discharge high pressure pumps 5 have a common housing 20 and a common cylinder body 21. The variable discharge high pressure pumps 5 are similar in structure, and a detailed description will be given of only one of the variable discharge high pressure pumps 5. Each variable discharge high pressure pump 5 includes a pump housing 20 formed with a cam chamber 30. The cam chamber 30 extends in a lower part of the pump housing 20. The pump housing 20 has an upper end connected to a pump cylinder 21 formed with a cylinder bore. Low pressure fuel is fed from the low pressure fuel feed pump 11 (see FIG. 1) to the variable discharge high pressure pump 5 via a fuel inlet pipe 22 connected to the pump housing 20. A solenoid valve 60 is screwed to the top of the pump cylinder 21, and disposed in alignment with the cylinder bore.

A plunger 23 is slidably disposed in the bore of the pump cylinder 21. The plunger 23 has an upper end face which defines a pumping chamber 24 in conjunction with the inner circumferential surface of the cylinder bore. The pumping chamber 24 contracts and expands as the plunger 23 moves upward and downward respectively. The pump cylinder 21 has a fuel discharge port 41 which extend from the pumping chamber 24 to the fuel feed line 12 (see FIG. 1) leading to the common rail 4 (see FIG. 1).

A fuel chamber 26 is defined between the pump housing 20 and the pump cylinder 21. The low pressure fuel flows through the fuel inlet pipe 22, and then enters the fuel chamber 26. The fuel chamber 26 serves as a reservoir for receiving fuel which is spilled or returned from the pumping chamber 24.

The fuel discharge port 41 extends to an outlet 45 via a check valve 42. Fuel pressurized in the pumping chamber 24 by the upward movement of the associated plunger 23 forces a valve member 43 of the check valve 42 from its closed position against the force of a return spring 44 and the common rail pressure. When the valve member 43 of the check valve 42 separates from the closed position, the pressurized fuel flows into the common rail 4 (see FIG. 1) via the outlet 45 and the fuel feed line 12.

The lower end of the plunger 23 is connected to a spring retainer 35 which is urged by a return spring 27 against a slidable tappet 34 provided with a cam roller 33. A cam shaft 31 is accommodated in the cam chamber 30. The cam shaft 31 is coupled to the crankshaft of the engine 2 (see FIG. 1) via a suitable mechanism so that the cam shaft 31 will rotate at a speed equal to a half of the rotational speed of the engine 2. A cam 32 in contact with the cam roller 33 is mounted on the cam shaft 31. The combination of the cam 32, the cam roller 33, and the tappet 34 allows the plunger 23 to be reciprocated in the up-down direction according to the rotation of the cam shaft 31. Downward movement of the plunger 23 is enabled by the force of the return spring 27. The characteristics of movement of the plunger 23 are determined by the cam profile of the cam 32.

The bottom dead center of each plunger 23 is now defined as corresponding to a cam angle of 0 degree. The cam 32 is of approximately an ellipsoidal shape in cross section, having a concave circumferential surface 32*c* and a convex surface 32*d*. The concave circumferential surface 32*c* extends in a range corresponding to a cam angle range from 0 degree to about 30 degrees. The concave circumferential surface 32*c* has a predetermined radius R1 of curvature. In addition, the cam profile of the cam 32 is designed so that the plunger 23 reaches its top dead center at a cam angle of 90 degrees.

The solenoid valve 60 has a valve member 62 operative to block and unblock a low pressure passage 61 extending to the pumping chamber 24. The low pressure passage 61 communicates with the fuel chamber 26 via a gallery 63 and a passage 64. The solenoid valve 60 is of the normally open type. In addition, the valve member 62 is of the outwardly-open type, and is designed so that it will be urged by the pressure in the pumping chamber 24 toward its closed position. When the solenoid valve 60 is in its normal state, that is, when the solenoid valve 60 is de-energized, the valve member 62 is separated from its valve seat by the force of a spring 65 (see FIG. 12) so that the low pressure passage 61 is unblocked. When the solenoid valve 60 is energized, the valve member 62 is moved against the force of the spring 65 and is seated on its valve seat so that the low pressure passage 61 is blocked. The pressure of the fuel in the pumping chamber 24 exerts a force on the valve member 62 which urges the valve member 62 toward its closed position. Thus, the sealing characteristics of the solenoid valve 60 in the closed position increase as the fuel pressure rises.

As the plunger 23 is moved downward, the low pressure fuel is drawn into the pumping chamber 24 from the fuel chamber 26 via the solenoid valve 60. It should be noted that the solenoid valve 60 is open during the downward movement of the plunger 23. Under conditions where the solenoid valve 60 remains deenergized, that is, under conditions where the solenoid valve 60 remains open, as the plunger 23 is moved upward, the fuel is spilled or returned from the pumping chamber 24 to the fuel chamber 26 via the low pressure passage 61, the gallery 63, and the passage 64 so that pressurizing the fuel in the pumping chamber 24 is substantially absent.

During the upward movement of the plunger 23, when the solenoid valve 60 is energized, the valve member 62 of the solenoid valve 60 blocks the low pressure passage 61 so that the spill or return of the fuel from the pumping chamber 24 toward the fuel chamber 26 is inhibited and thus the fuel in the pumping chamber 24 starts to be pressurized. When the fuel pressure applied to the upstream side of the valve member 43 of the check valve 42 overcomes the sum of the force of the return spring 44 and the pressure in the common rail 4 which act on the downstream side of the valve member 43, the check valve 42 is opened so that the high pressure fuel is driven from the pumping chamber 24 to the common rail 4 via the fuel discharge port 41, the outlet 45, and the fuel feed line 12 (see FIG. 1).

As described previously, the number of the variable discharge high pressure pumps 5 is equal to a half of the number of the cylinders of the engine 2. In this embodiment, there are three variable discharge high pressure pumps 5. As shown in FIG. 3, a timing gear 36 is provided on the cam shaft 31. In addition, the variable discharge high pressure pumps 5 are provided on the cam shaft 31. In FIG. 3, only two of the variable discharge high pressure pumps are shown as being denoted by the reference characters 5*a* and 5*b*. Members denoted by the reference numerals followed by the reference characters "a" or "b" in FIG. 3 are similar in structure to the members of FIG. 2 which are denoted by the corresponding reference numerals without being followed by the reference characters "a" or "b". Accordingly, the details of the structure of the members in FIG. 3 can be understood by referring to FIG. 2.

The timing gear 36 has radially outward projections 37, the number of which is equal to the number of the cylinders of the engine 2. In this embodiment, there are six projections 37. The projections 37 are spaced at equal angular intervals. A cam angle sensor 38 including an electromagnetic pickup is provided radially outward of the timing gear 36. During the rotation of the timing gear 36, the cam angle sensor 38 senses the projections 37 on the timing gear 36, outputting a signal representing timings at which the plungers 23*a*, 23*b*, . . . of the variable discharge high pressure pumps 5*a*, 5*b*, . . . start to move upward, that is, timings at which the plungers 23*a*, 23*b*, . . . of the variable discharge high pressure pumps 5*a*, 5*b*, . . . reach bottom dead centers. The output timing signal from the cam angle sensor 38 is fed to the ECU 6.

Figure 4:
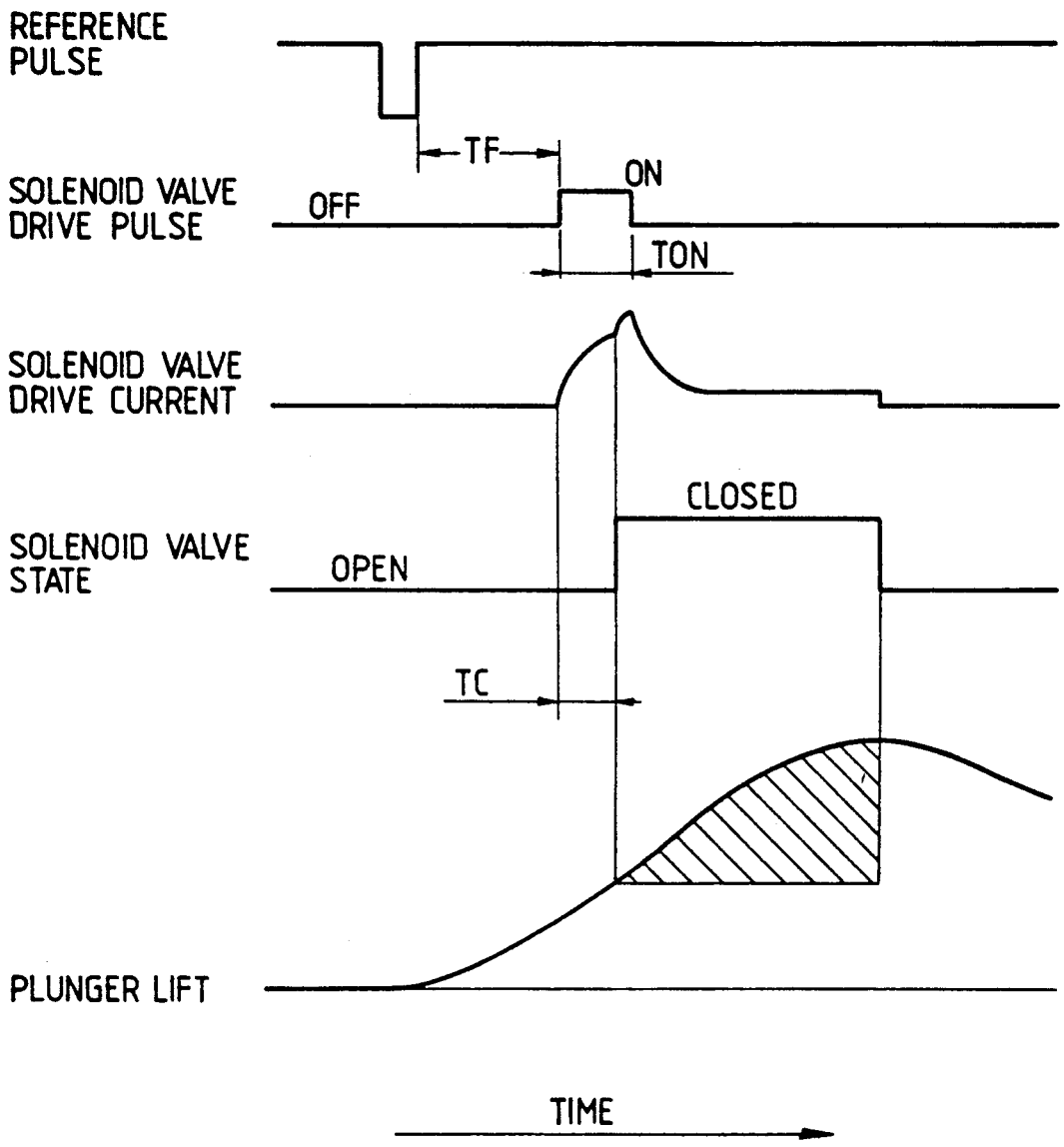
FIG. 4 is a time-domain diagram showing the waveforms of signals and a current, the changes in the state of a solenoid valve, and the variations in the lift of a plunger in respect of a variable discharge high pressure pump in FIG. 1.

The ECU 6 outputs electric drive pulses to the solenoid valves 60*a*, 60*b*, . . . in response to the timing signal fed from the cam angle sensor 38. The output timing signal from the cam angle sensor 38 includes a reference pulse (see FIG. 4) which occurs at a moment corresponding to the bottom dead center of a plunger 23 of one of the variable discharge high pressure pumps 5. As shown in FIG. 4, an electric drive pulse is outputted from the ECU 6 to a solenoid valve 60 at a moment which follows the moment of the occurrence of the reference pulse by an output wait interval TF. The solenoid valve 60 is energized by the drive pulse, being closed. As shown in FIG. 4, the rate of increased in the drive current through the solenoid valve 60 is limited, and there is a time lag (a valve closing delay) TC between the moment of the occurrence of the leading edge of the drive pulse and the moment of the occurrence of movement of the valve member 62 of the solenoid valve 60 into its closed position. Then, upward movement of the plunger 23 of a variable discharge high pressure pump 5 increases the pressure in the pumping chamber 24. The increased pressure in the pumping chamber 24 serves to hold the valve member 62 in its closed position. As shown in FIG. 4, after a given short period TON elapses since the moment of the occurrence of the leading edge of the drive pulse, the drive pulse is ended and removed to save electric power. It should be noted that the valve member 62 is held in its closed position by the increased pressure in the pumping chamber 24 after the drive pulse is removed.

The period between the moment of closing the solenoid valve 60 and a moment corresponding to the top dead center of the plunger 23 is equal to the interval of pressurizing the fuel in the pumping chamber 24. During the fuel pressurizing interval, the amount of fuel which is proportional to the area of the hatched part of FIG. 4 is pumped from the pumping chamber 23 toward the common rail 4. As the timing of outputting the drive pulse is earlier, a larger amount of fuel is pumped to the common rail 4. As the timing of outputting the drive pulse is retarded, a smaller amount of fuel is pumped to the common rail 4. Thus, the pressure in the common rail 4 can be adjusted in accordance with the timing of outputting the drive pulse, that is, in accordance with the output wait time TF.

Figure 5:
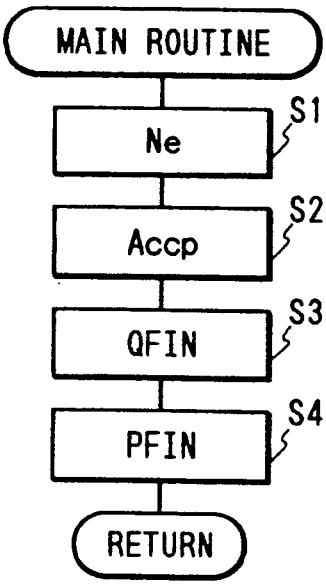
FIG. 5 is a flowchart of a main routine of a program for controlling the ECU in FIG. 1.

The ECU 6 includes a microcomputer having a combination of a CPU, a ROM, a RAM, and an I/O port. The ECU 6 operates in accordance with a program stored in the ROM. The program has a main routine which is periodically reiterated. FIG. 5 is a flowchart of the main routine of the program.

As shown in FIG. 5, the main routine of the program starts at a step S1 which calculates the current engine speed Ne on the basis of the output signal from the engine speed sensor 7. A step S2 following the step S1 executes the analog-to-digital conversion of the output signal from the accelerator sensor 8, and derives the current degree Accp of depression of the accelerator pedal. Specifically, the I/O port within the ECU 6 includes an analog-to-digital converter processing the output signal from the accelerator sensor 8, and the step S2 executes the analog-to-digital conversion by using this analog-to-digital converter. The current accelerator depression degree Accp is represented by a percentage (%) with respect to the maximum accelerator depression degree.

Figure 6:
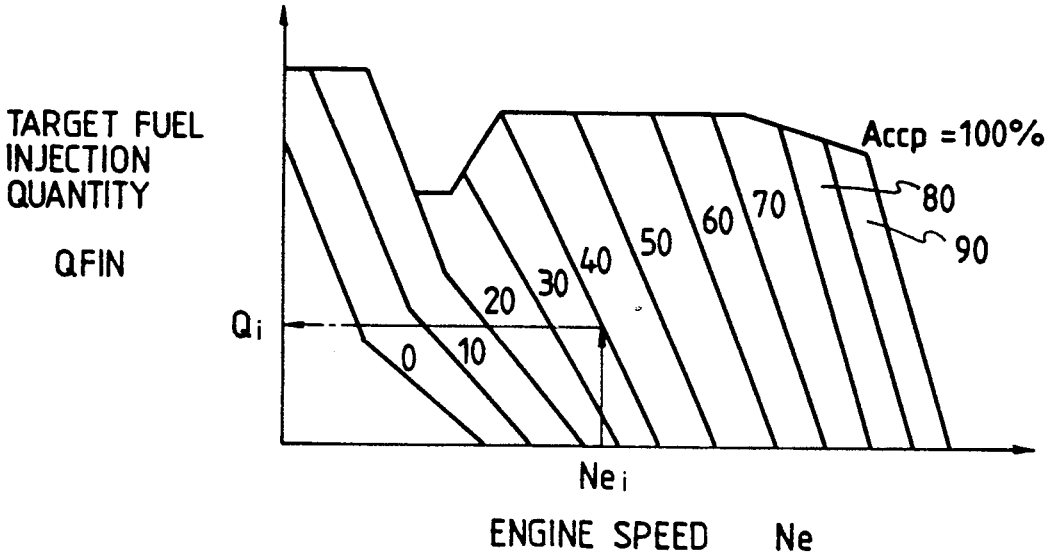
FIG. 6 is a diagram showing a map for calculating a target fuel injection quantity.

A step S3 following the step S2 determines a target fuel injection quantity QFIN on the basis of the current engine speed Ne and the current accelerator depression degree Accp. Specifically, the ROM within the ECU 6 holds a map such as shown in FIG. 6 where values of the target fuel injection quantity are plotted as a function of the engine speed and the accelerator depression degree. The target fuel injection quantity QFIN is determined by referring to the map of FIG. 6. The step S3 stores the determined target fuel injection quantity QFIN into the RAM within the ECU 6.

Figure 7:
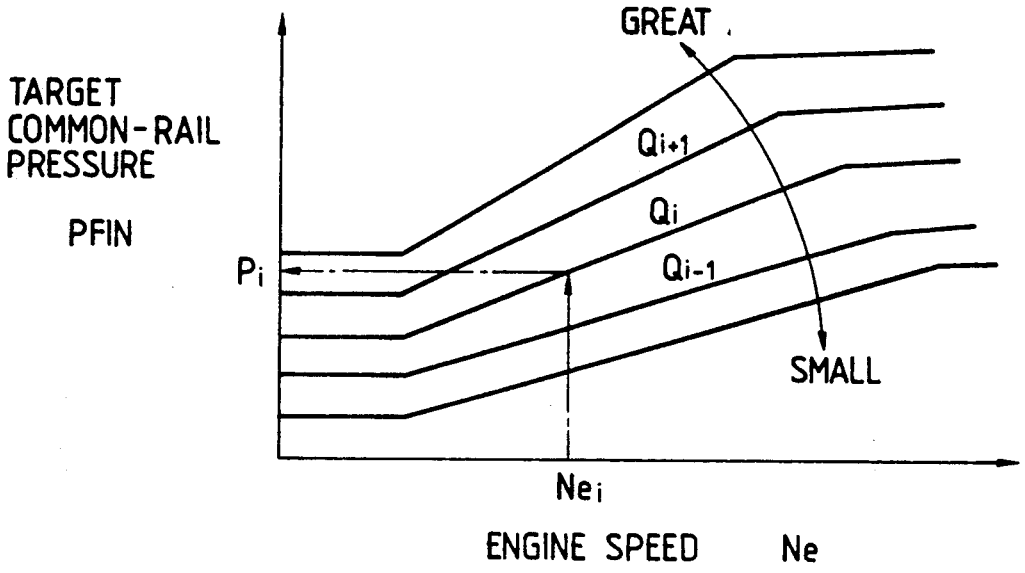
FIG. 7 is a diagram showing a map for calculating a target common-rail pressure.

A step S4 following the step S3 determines a target common-rail pressure PFIN on the basis of the current engine speed Ne and the current accelerator depression degree Accp. Specifically, the ROM within the ECU 6 holds a map such as shown in FIG. 7 where values of the target common-rail pressure are plotted as a function of the engine speed and the accelerator depression degree. The target common-rail pressure PFIN is determined by referring to the map of FIG. 7. The step S4 stores the determined target common-rail pressure PFIN into the RAM within the ECU 6. After the step S4, the current execution cycle of the main routine ends.

Figure 8:
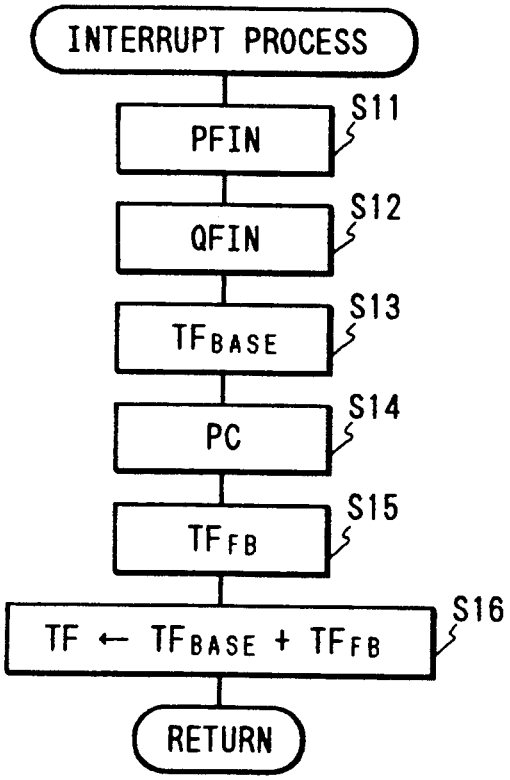
FIG. 8 is a flowchart of a section of the program controlling the ECU in FIG. 1.

The program for controlling the ECU 6 has a section which is started by an interruption process responsive to the output signal from the cam angle sensor 38 or the output signal from the crank angle sensor 15. Specifically, this section of the program is executed in synchronism with the compression strokes of the cylinders of the engine 2. FIG. 8 is a flowchart of this section of the program.

As shown in FIG. 8, this section of the program starts at a step S11 which reads out the target common-rail pressure PFIN from the RAM within the ECU 6. A step S12 following the step S11 reads out the target fuel injection quantity QFIN from the RAM within the ECU 6.

Figure 9:
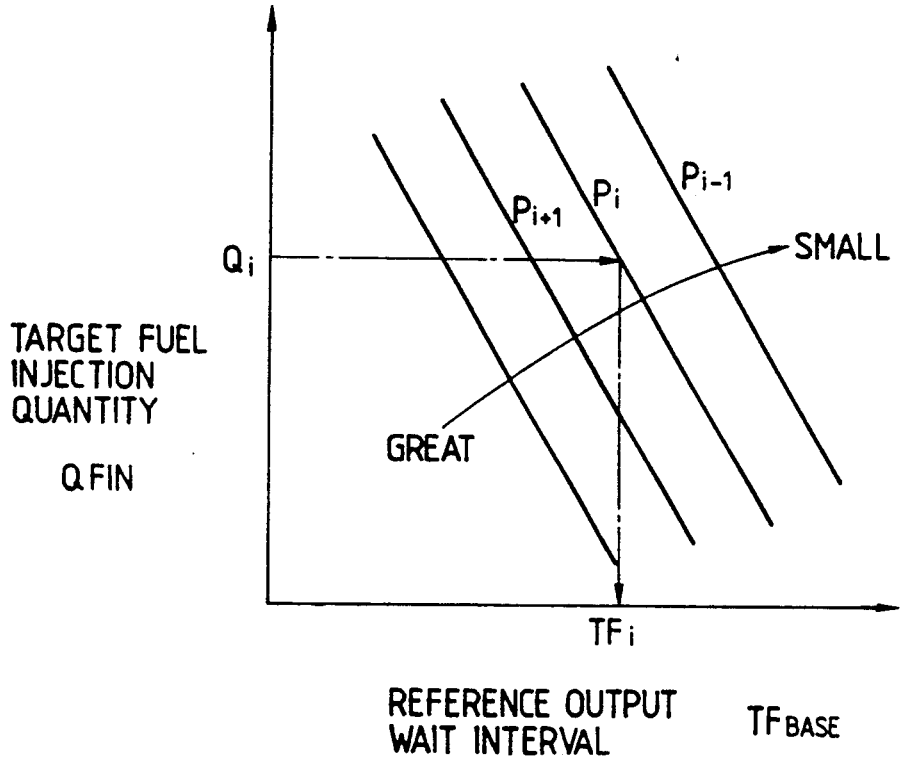
FIG. 9 is a diagram showing a map for calculating a reference output wait interval.

A step S13 following the step S12 determines a reference value TFBASE of a drive-pulse wait interval (a reference output wait interval TFBASE) on the basis of the target common-rail pressure PFIN an the target fuel injection quantity QFIN. Specifically, the ROM within the ECU 6 holds a map such as shown in FIG. 9 where values of the reference output wait interval are plotted as a function of the target common-rail pressure and the target fuel injection quantity. The reference output wait interval TFBASE is determined by referring to the map of FIG. 9.

A step S14 following the step S13 executes the analog-to-digital conversion of the output signal from the common-rail pressure sensor 9, and derives the actual common-rail pressure PC. Specifically, the I/O port within the ECU 6 includes an analog-to-digital converter processing the output signal from the common-rail pressure sensor 9, and the step S14 executes the analog-to-digital conversion by using this analog-to-digital converter.

A step S15 following the step S14 calculates the difference $\Delta P$ between the actual common-rail pressure PC and the target common-rail pressure PFIN by referring to the equation "$\Delta P = PC - PFIN$". The step S15 calculates a corrective value TFFB on the basis of the pressure difference $\Delta P$. The corrective value TFFB is designed so as to correct the reference output wait interval TFBASE. The calculation of the corrective value TFFB is done according to a PID-control technique.

A step S16 following the step S15 calculates a final output wait interval TF from the reference output wait interval TFBASE and the corrective value TFFB by referring to the equation "$TF = TFBASE + TFFB$". The step S16 stores the calculated final output wait interval TF into the RAM within the ECU 6. After the step S16, the program returns to the main routine.

Figure 11:
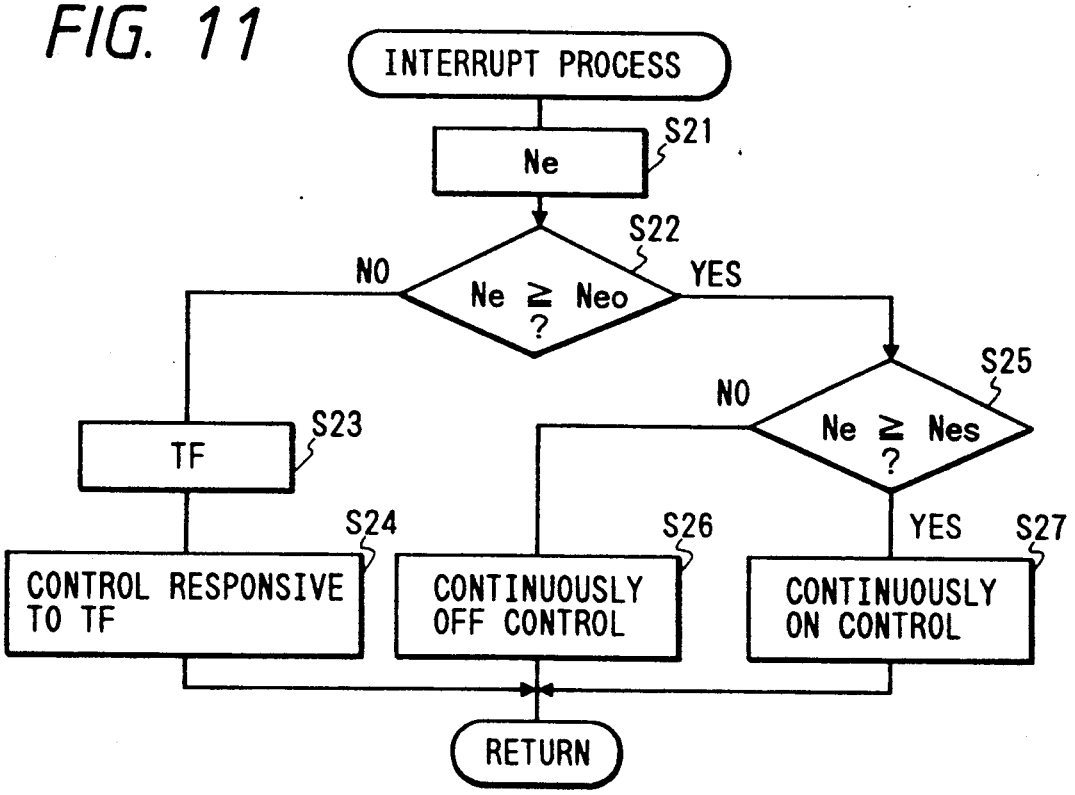
FIG. 11 is a flowchart of another section of the program controlling the ECU in FIG. 1.

The program for controlling the ECU 6 has another section which is started by an interruption process responsive to the output signal from the cam angle sensor 38 or the output signal from the crank angle sensor 15. Specifically, this section of the program is executed in synchronism with the compression strokes of the cylinders of the engine 2. FIG. 11 is a flowchart of this section of the program.

As shown in FIG. 11, this section of the program starts at a step S21 which reads out the current engine speed Ne from the RAM within the ECU 6. A step S22 following the step S21 compares the current engine speed Ne with an overrunning reference speed Neo. When the current engine speed Ne is lower than the overrunning reference speed Neo, that is, when the engine 2 is not overrunning, the program advances from the step S22 to a step S23. When the current engine speed Ne is equal to or higher than the overrunning reference speed Neo, that is, when the engine 2 is overrunning, the program advances from the step S22 to a step S25.

The step S23 reads out the final output wait interval TF from the RAM within the ECU 6. A step S24 following the step S23 executes an outputting process by which a drive pulse of a given duration is outputted to a solenoid valve 60 at a timing depending on the final output wait interval TF. Specifically, the timing of outputting the drive pulse follows the timing of the movement of the plunger 23 of a variable discharge high pressure pump 5 into the bottom dead center by a period equal to the final output wait interval TF. After the step S24, the program returns to the main routine.

The step S25 compares the current engine speed Ne with a self-closing limit speed Nes higher than the overrunning reference speed Neo. When the current engine speed Ne is lower than the self-closing limit speed Nes, the program advances from the step S25 to a step S26. When the current engine speed Ne is equal to or higher than the self-closing limit speed Nes, the program advances from the step S25 to a step S27.

The step S26 continuously de-energizes the solenoid valve 60 in order to hold the solenoid valve 60 open independent of the final output wait interval TF. After the step S26, the program returns to the main routine.

The step S27 continuously energizes the solenoid valve 60 in order to hold the solenoid valve 60 closed independent of the final output wait interval TF. After the step S27, the program returns to the main routine.

In order to prevent the engine 2 from overrunning, the fuel injection into the cylinders of the engine 2 is suspended at an engine speed equal to or higher than the lower limit Neo of an overrunning engine speed range. The overrunning limit speed Neo is generally equal to about 3,000 rpm. At an engine speed in the overrunning engine speed range, pumping fuel into the common rail 4 is suspended to prevent an excessive increase in the pressure in the common rail 4. The suspension of the fuel supply to the common rail 4 is generally executed by holding the solenoid valves 60 open.

Figure 10:
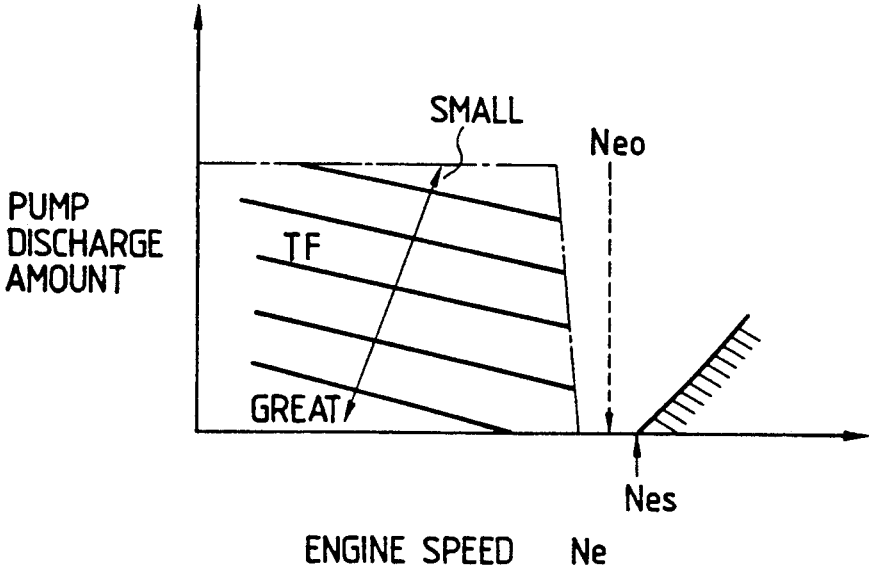
FIG. 10 is a diagram showing the relation among an engine speed, a pump discharge quantity, and an output wait interval.

In a prior art common-rail fuel injection system for a diesel engine, at high engine speeds, plungers of variable discharge high pressure pumps move up and down at high speeds so that valve members of solenoid valves (corresponding to the solenoid valves 60 of the embodiment of this invention) tend to be forced upward into their closed positions by the inertia of fuel in pumping chambers of the high pressure pumps. The lower limit of an engine speed range where such a valve self-closing phenomenon occurs is defined as a self-closing limit speed Nes equal to about 4,000 rpm. Thus, in the prior art common-rail fuel injection system, as shown in the hatched part of FIG. 10, the fuel supply to the common rail tends to be caused by valve self-closing at an engine speed higher than the self-closing limit speed Nes.

Such a problem of the prior art common-rail fuel injection system is prevented in the embodiment of this invention as will be explained hereinafter. In the embodiment of this invention, when the current engine speed Ne is lower than the overrunning reference speed Neo, each solenoid valve 60 is controlled in response to the final output wait interval TF by the step S24 of FIG. 11 and thus the feedback control of the common-rail pressure is executed so that the actual pressure in the common rail 4 can be maintained at the target common-rail pressure PFIN. The target common-rail pressure PFIN is designed so as to realize suitable fuel injection into the cylinders of the engine 2 in response to the operating conditions of the engine 2 such as the engine speed Ne and the accelerator depression degree Accp. In the embodiment of this invention, when the current engine speed Ne lies between the overrunning reference speed Neo and the self-closing limit speed Nes, each solenoid valve 60 is held continuously de-energized by the step S26 of FIG. 11 so that the solenoid valve 60 remains open. Thus, in this case, the fuel supply to the common rail 4 from the pumping chamber 24 of each variable discharge high pressure pump 5 remains suspended. The fuel injection into the cylinders of the engine 2 is interrupted at an engine speed equal to or higher than the overrunning reference speed Neo, and the suspension of the fuel supply to the common rail 4 prevents an excessive increase in the pressure in the common rail 4 at such an engine speed. In the embodiment of this invention, when the current engine speed Ne is equal to or higher than the self-closing limit speed Nes, each solenoid valve 60 is held continuously energized by the step S27 of FIG. 11 so that the solenoid valve 60 remains closed. Thus, in this case, the fuel feed into each pumping chamber 24 from the fuel chamber 26 according to the downward movement of the plunger 23 remains inhibited, and then further fuel supply to the common rail 4 from each pumping chamber 24 remains suspended. The suspension of the fuel supply to the common rail 4 prevents an excessive increase in the pressure in the common rail 4.

It should be noted that the embodiment of this invention may be modified in various ways. For example, according to a first modification, when the current engine speed Ne is equal to or higher than the self-closing limit speed Nes, a low pressure fuel feed pump 11 is deactivated instead of continuously closing solenoid valves 60. A second modification includes passages for feeding fuel to pumping chambers 24, passages for returning fuel from the pumping chambers 24 which are separate from the fuel feed passages, and fuel feed control valves for blocking and unblocking the fuel feed passages. In the second modification, when the current engine speed Ne is equal to or higher than the self-closing limit speed Nes, the fuel feed control valves are closed instead of continuously closing solenoid valves 60. In a third modification, energizing each solenoid valve 60 continuously is executed at engine speeds, the lower limit of which is smaller than the self-closing limit speed Nes and is equal to, for example, the overrunning reference speed Neo.

What is claimed is:

1. A common-rail fuel injection system for an engine, comprising:

fuel injection means for injecting high pressure fuel from a common rail into a engine;

a pumping chamber connected to the common rail;

fuel feed means for feeding fuel to the pumping chamber;

a plunger, operatively connected so as to move with rotation of an output shaft of the engine, movable within the pumping chamber;

a relief valve for selectively returning fuel from the pumping chamber to a low pressure fuel chamber via a fuel return passage, and for selectively introducing fuel from the low pressure fuel chamber to the pumping chamber, the relief valve being urged toward its closed position by a pressure of the fuel in the pumping chamber;

valve closing means for closing the relief valve when the valve closing means is energized;

fuel pumping control means for driving and controlling the valve closing means at a given timing to close the relief valve, thereby enabling a pressure in the pumping chamber to increase in accordance with a first movement of the plunger, and for pumping a given amount of fuel from the pumping chamber to the common rail;

engine speed detecting means for detecting a rotational speed of the output shaft of the engine;

first fuel supply suspending means for suspending a fuel supply to the common rail by continuously driving the valve closing means in a de-energized condition when the engine rotational speed detected by said engine speed detecting means is lower than a predetermined reference speed; and second fuel supply suspending means for suspending a fuel supply to the common-rail by continuously driving the valve closing means in an energized condition when the engine rotational speed detected by said engine speed detecting means is equal to or higher than a predetermined reference speed.

2. The common-rail fuel injection system of claim 1, wherein said engine is a diesel engine.

3. The common-rail fuel injection system of claim 1, wherein said first fuel supply suspending means comprises means for, in cases where a fuel supply to the common rail in unwanted and an engine rotational speed detected by the engine speed detecting means is lower than the predetermined reference speed but is higher than a second predetermined reference speed, continuously driving the valve closing means in the de-energized condition.

4. The common-rail fuel injection system of claim 1, wherein said predetermined reference speed is within a predetermined range corresponding to overrunning conditions of the engine.

5. The common-rail fuel injection system of claim 3, wherein said second predetermined reference speed corresponds to a beginning of overrunning of the engine.

6. A method of using a common-rail fuel injection system for an engine, said system comprising:

fuel injection means for injecting high pressure fuel from a common rail into a engine;

a pumping chamber connected to the common rail;

fuel feed means for feeding fuel to the pumping chamber;

a plunger, operatively connected so as to move with rotation of an output shaft of the engine, movable within the pumping chamber;

a relief valve for selectively returning fuel from the pumping chamber to a low pressure fuel chamber via a fuel return passage, and for selectively introducing fuel from the low pressure fuel chamber to the pumping chamber, the relief valve being urged toward its closed position by a pressure of the fuel in the pumping chamber;

valve closing means for closing the relief valve when the valve closing means is energized;

fuel pumping control means for driving and controlling the valve closing means at a given timing to close the relief valve, thereby enabling a pressure in the pumping chamber to increase in accordance with a first movement of the plunger, and for pumping a given amount of fuel from the pumping chamber to the common rail;

engine speed detecting means for detecting a rotational speed of the output shaft of the engine;

said method comprising the steps of:

(a) first means for suspending a fuel supply to the common rail by continuously driving the valve closing means in a de-energized condition when the engine rotational speed detected by said engine speed detecting means is lower than a predetermined reference speed;

(b) second means for suspending a fuel supply to the common rail by continuously driving the valve closing means in an energized condition when the engine rotational speed detected by said engine speed detecting means is equal to or higher than a predetermined reference speed.

* * * * *